United States Patent [19]

Strickland

[11] 4,006,502

[45] Feb. 8, 1977

[54] PACKAGING AND APPLICATOR TOOL FOR ELECTRICAL TERMINALS

[76] Inventor: Robert V. Strickland, 9021 Wedd, Overland Park, Kans. 66212

[22] Filed: Jan. 12, 1976

[21] Appl. No.: 648,300

[52] U.S. Cl. ..... 7/5.4; 72/410; 29/566.2; 29/751

[51] Int. Cl.[2] ..... B25F 1/00

[58] Field of Search ..... 29/203 D, 203 H, 203 HM, 29/203 HC; 72/410; 7/5.4, 14.1 R

[56] References Cited

UNITED STATES PATENTS

| | | | |
|---|---|---|---|
| 2,829,549 | 4/1958 | Demler | 29/203 HM |
| 3,553,999 | 1/1971 | Rommel | 29/203 H |
| 3,800,584 | 4/1974 | Edwards, Sr. | 29/203 H |

FOREIGN PATENTS OR APPLICATIONS

| | | | |
|---|---|---|---|
| 562,095 | 5/1957 | Italy | 30/135 |

*Primary Examiner*—Al Lawrence Smith
*Assistant Examiner*—Roscoe V. Parker
*Attorney, Agent, or Firm*—John A. Hamilton

[57] ABSTRACT

In connection with electrical terminals which are elongated and each having at one end a tubular ferrule adapted to be crimped about a stripped conductor wire inserted therein, a packaging therefor in which a series of the terminals are adhered in spaced relation along a flexible tape, and an applicator tool comprising a plier-like device having three sets of jaws, a first-closing spring loaded set operable to grip the end terminal of the series loosely, a second-closing spring loaded set operable to cut the tape to sever the gripped terminal from the series, and a third-closing rigid set operable to crimp the ferrule of the terminal.

7 Claims, 11 Drawing Figures

PACKAGING AND APPLICATOR TOOL FOR ELECTRICAL TERMINALS

Figure 1:
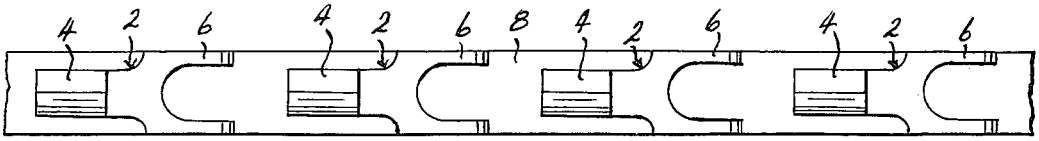

This invention relates to new and useful improvements in the packaging and use of small electrical terminals adapted to be affixed to the ends of electrical wires, in order to facilitate the connection of said wires to the terminal posts or other elements of electrical apparatus. Such terminals are commonly mounted on the wire particularly when the connection is intended to be readily detachable and reattachable, in lieu of soldering or other more permanent connections.

Such wire terminals are made of conducting metal and are commonly somewhat elogated, having at one end a tubular ferrule and at the oppoosite end a sheet metal U-form, eye, hook, tube or post adapted to be joined to a mating device on the electrical device served by a conductor wire inserted into the ferrule, and about which the ferrule is permanently crimped by means of a plier-type tool. The application of such wire terminals to the wires, on a constantly repetitive assembly line basis, has heretofore been a tedious, time consuming operation. The terminals are often very small and hard to handle, and are ordinarily supplied in bins or boxes. The operator must carefully take one terminal from the bin, manually orient it properly to the jaws of the plier-type tool and grip the ferrule with the tool jaws, but not tightly enough to crimp the ferrule, then with the other hand insert the previously stripped end of the wire into the ferrule, and finally apply greater pressure to the tool jaws to crimp the ferrule tightly about the wire. The entire procedure is tedious, time consuming, and hence unduly expensive.

The object of the present invention is to simplify the operation just described, and to render it much easier and faster for the operator. The invention includes a special packaging for the terminals. The packaging involves adhering the terminals in a repetitive series to a flexible tape, which may be wound on a rotatable spool or the like, with the terminal portion of the tape hanging free of the spool in a position convenient to the operator. The invention also involves a special applicator tool. The tool is of a plier type, including a pair of rigid cooperating jaws operable by hand grips to crimp the ferrule of a terminal, but also two additional sets of jaws, operable by the same hand grips, the jaws of each set being spring loaded for limited movement toward each other, and being separable to a greater spacing than can be offset by the closing springs. The spring loaded jaws are disposed at one side of the rigid jaws, and both close before the rigid jaws but at different times. In use, the jaws are aligned with the end terminal on the dangling tape of the package, and partially closed. One of the sets of spring loaded jaws closes first, resiliently gripping the terminal between its ends, but not the ferrule portion thereof. The second set of spring loaded jaws closes next, and constitute a cutter operable to sever the tape between the last two terminals. The tool may then be moved to any desired position by the operator, the stripped wire end inserted into the ferrule, and the rigid jaws closed to crimp the ferrule about the wire. Thus the entire operation is completed with no necessity that the operator ever touch or handle the terminals.

Another object is the provision of an applicator tool of the character described which is capable of applying wire terminals of many different types and styles.

Other objects are simplicity and economy of construction efficiency and dependability of operation.

Figure 2:
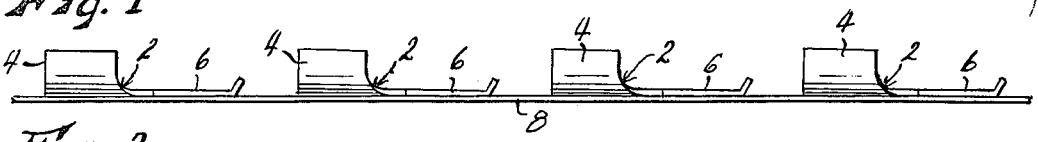
Figure 3:
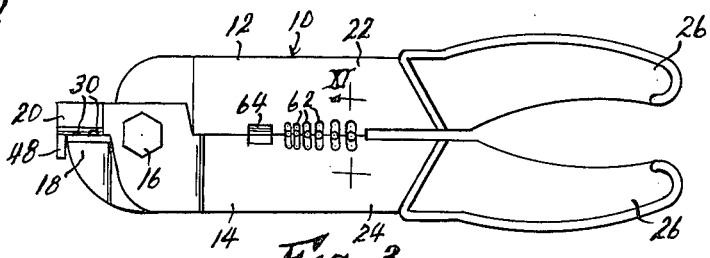
Figure 11:
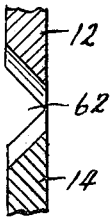
Figure 4:
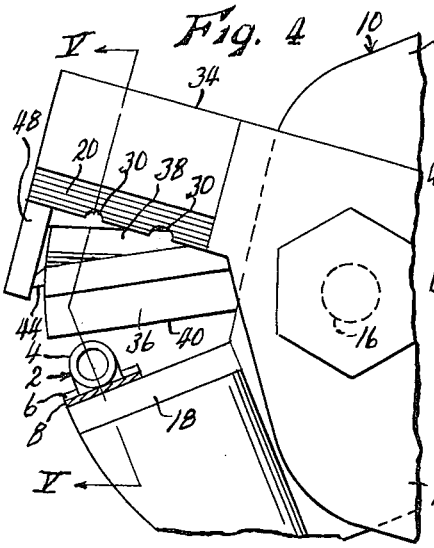
Figure 6:
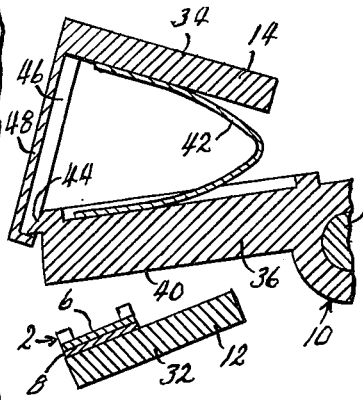
Figure 7:
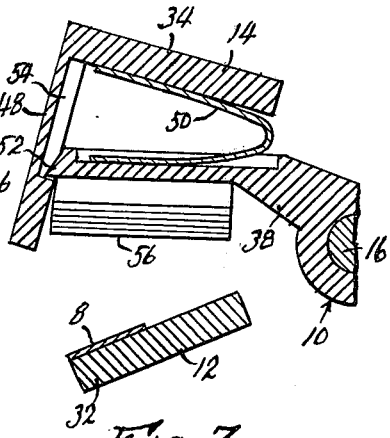
Figure 5:
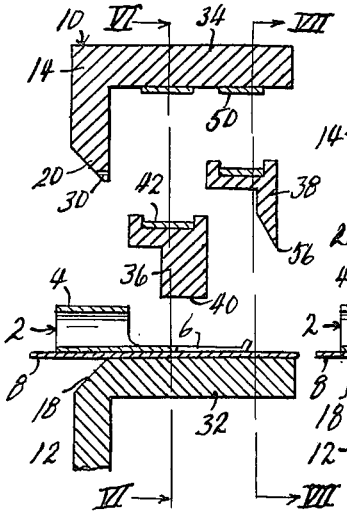
Figure 8:
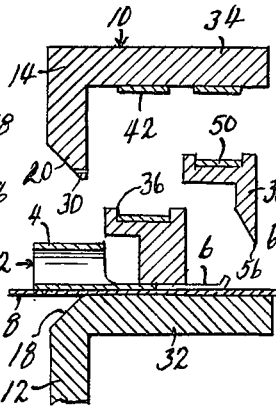
Figure 9:
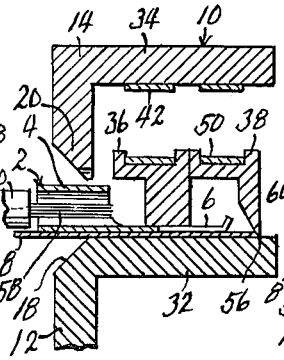
Figure 10:
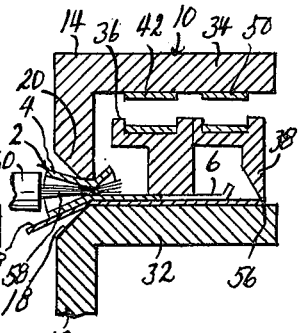

With these objects in view, as well as other objects which will appear in the course of the specification, reference will be had to the accompanying drawing, wherein:

FIG. 1 is a top plan view of a series of electrical wire terminals secured to a flexible tape in accordance with the packaging aspect of the present invention, FIG. 2 is a side elevational view of the elements shown in FIG. 1, FIG. 3 is a side elevational view, to a reduced scale, of an applicator tool embodying the present invention, FIG. 4 is an enlarged, fragmentary view similar to FIG. 3, and showing the jaws of the tool in a wide open position, and in operative relation to a terminal, FIG. 5 is a slightly irregular sectional view taken on line V—V of FIG. 4, FIG. 6 is a fragmentary sectional view taken on line VI—VI of FIG. 5, FIG. 7 is a fragmentary, sectional view taken on line VII—VII of FIG. 5, FIG. 8 is a view similar to FIG. 5, but showing the jaws partially closed to provide an initial grip on the terminal, FIG. 9 is a view similar to FIG. 8, but with the jaws additionally closed to sever the tape, FIG. 10 is a view similar to FIG. 9, but showing the jaws completely closed to crimp the ferrule of the terminal, and FIG. 11 is an enlarged, fragmentary sectional view taken on line XI—XI of FIG. 3.

Like reference numerals apply to similar parts throughout the several views, and the numeral 2 applies generally to a terminal for an electric wire of a type usable in the present invention. It is formed of sheet metal and is somewhat elongated, having at one end a cylindrically tubular ferrule 4 with its axis parallel to the longitudinal extent of the terminal, and at its opposite end a connector portion 6 adapted to be secured detachably in one way or aother to a piece of electrical apparatus. As shown, connector portion 6 is a flat, U-shaped form, and is adapted to be inserted under the head of a terminal post screw of the apparatus. It may have other flat forms, such as rings, J-hooks and the like, and also it may not be flat, but may have the form of pins or tubular sockets, for sliding connection to mating elements of the electrical apparatus.

As shown most clearly in FIGS. 1 and 2, the packaging aspect of the present invention contemplates adhering a series of the terminals 2 to a flexible tape 8 made of plastic, paper, or the like. The terminals are spaced apart along the tape, and all similarly oriented relative to the tape. The tape may be of any desired length, and may be wound loosely on a spool or the like. In accordance with the present invention, such a spool would be supported rotatably on a horizontal axis adjacent the work station of an operator, with the end portion of the tape hanging free of the spool in a position convenient to the operator.

The numeral 10 applies geneally to the applicator tool used in the present invention. Said tool is of a plier-type, including a pair of rigid bars 12 and 14 pivoted together intermediate their ends, on a transverse axis, by means of a pivot bolt 16. Said bars extend in one direction from their pivot to form, respectively, a lower jaw 18 and an upper jaw 20, and in the opposite direction to form handles 22 and 24, to the free ends of which are attached hand grips 26. Bars 12 and 14 intersect each other at pivot 16, in order that movement of handles 22 and 24 toward each other forces jaws 18 and 20 toward each other. As will appear, jaws 18 and 20 cooperate when closed to crimp the tubular ferrule 4 of a terminal 2 therebetween, and to this end one or both of said jaws may be provided with one or more semi-cylindrical notches 30 to accomodate the cylindrical form of said ferrule. The operative edges of jaws 18 and 20 are radial to pivot 16.

The upper edge of lower jaw 18 is extended laterally of said jaw to form a planar anvil 32, the upper surface of which coincides with the operative edge of said jaw, and is radial to pivot 16. Said anvil serves as the lower jaw for a pair of spring-loaded upper jaws to be described. The extreme upper edge of upper jaw 20 is also extended laterally, generally coextensively with anvil 32, to form a spring retainer plate 34, which is spaced well above the operative edge of jaw 20, and well above anvil 32 even when jaws 18 and 20 are completely closed.

Pivot bolt 16 is also extended in the same direction as lateral extensions 32 and 34 of the jaws. As best shown in FIG. 6, there is pivoted on bolt 16 a clamp jaw 36, and as shown in FIG. 7, a blade jaw 38, clamp jaw 36 being disposed directly adjacent rigid jaws 18 and 20, and blade jaw 38 being spaced further from jaws 18 and 20. Said clamp and blade jaws extend from their pivotal mounting on bolt 16 into the space between anvil 32 and retainer plate 34. The operative lower edge 40 of clamp jaw 36 is planar and rather broad, and is radial to pivot 16. Said clamp jaw is biased toward a closed position against anvil 32 by a leaf spring 42 the ends of which bear respectively against the top edge of said jaw and the lower face of retainer plate 34, but its movement toward said closed position, relative to upper jaw 20, is limited by a dog 44 carried at its free end, which is engaged in a slot 46 formed in the inner surface of a skirt 48 formed integrally with retainer plate 34 and depending from the forward edge thereof. Movement of clamp jaw 36 by spring 42, relative to jaw 20, is arrested when dog 44 engages the lower end of slot 46. Similarly, blade jaw 38 is biased toward a closed position by another leaf spring 50, this movement relative to jaw 20 being limited by the engagement of a dog 52 of said blade jaw in another slot 54 of skirt 48, as best shown in FIG. 7. The lower edge 56 of the jaw 38 constitutes a sharp cutting edge which is also radial to pivot 16. Slot 54 permits less movement of the blade jaw, rleative to jaw 20, than the movement of the clamp jaw permitted by slot 46.

In operation, it will be seen that when rigid jaws 18 and 20 are fully open, as shown in FIG. 4, all of the jaws are open. That is, jaws 20, 36 and 38 are all spaced upwardly from anvil 32, which serves as a lower jaw cooperating with all of jaws 20, 36 and 38. However, as jaw 20 opens, jaws 36 and 38 close partially under the action of their springs 42 and 50, until their closure is arrested by their dogs 44 and 52, after whch they also open. Thus if jaw 20 is opened till jaw 36 is also opened, as shown in FIG. 5, jaw 36 will be open to the least degree, jaw 38 to an intermediate degree, and jaw 20 to the greatest jaw 38 to an intermediate degree, and jaw 20 to the greatest degree.

Then, with the jaws in this open position, the operator, who of course is holding the tool by hand grips 26, positions the tool relative to the endmost terminal 2 on tape 8, as shown in FIGS. 4 and 5, with tape 8 against anvil 32 and extending laterally of the jaws, and with ferrule 4 of the terminal positioned under jaw 20. As previously mentioned, this positioning may be performed while a portion of tape 8 dangles free of a rotatable spool supported in some convenient position. As shown in FIG. 5, the lateral spacing of the various jaws is such that when ferrule 4 of the terminal is aligned with jaw 20, as shown, jaw 36 will be aligned with end portion 6 of the terminal, and jaw 38 will be aligned with tape 8 intermediate the terminal under jaws 20 and 36, and the next successive terminal on the tape.

Next, the operator draws hand grips 26 closer together until clamp 36 engages portion 6 of the terminal, as shown in FIG. 8. This secures the terminal relative to the tool, but edge 56 of the blade jaw is still spaced apart from tape 8, and jaw 20 is spaced still further apart from ferrule 4.

Next, the operator draws grips 26 still closer together until cutting edge 56 of blade jaw 38 contacts and severs tape 8 against anvil 32, as shown in FIG. 9. The spring 42 of clamp jaw 36 of course yields during this movement, and spring 50 of the blade jaw is of sufficient strength to cause the blade to sever the tape. Blade 20 is still spaced apart from terminal ferrule 4. Since the tape section carrying the terminal between the jaws is then free of the remainder of the tape, the operator is then free to move the tool and terminal to any desired position.

Finally, the operator inserts the end portion of a wire 58, from which the insulation 60 has been stripped, into ferrule 4, also as shown in FIG. 9, and pulls grips 26 still closer together to move jaw 20 into crushing engagement with ferrule 4 to crimp it tightly and permanently about the wire, as shown in FIG. 10. During this final movement, the springs of both of jaws 36 and 38 yield to a still greater degree. Thus the attachment of the terminal to the wire is completed rapidly and expeditiously, with no necessity at any time that the operator directly touch or handle the terminals themselves, or lay the tool 10 down between successive steps of the process. The tape section still adhering to the ferrule may be peeled away at any later time.

Advantageously, tool 10 may incorporate therein means for stripping the insulation from the end portion of wire 58. This stripper means may constitute apertures 62, graduated to various wire sizes, formed in the confronting sharpened edges of bars 12 and 14 intermediate pivot 16 and hand grips 26, as shown in FIGS. 3 and 11, the operation of which is well known and need not be described here. The tool may also incorporate a wire cutter 64 constituting sharpened, but unnotched sections of the confronting edges of bars 12 and 14. With these additions, the operator may apply any number of terminals without ever laying down the tool. The wire would feed from a spool and be held in one hand of the operator, with the tool in his other hand. He would strip the wire in one of apertures 62, reach for, grip, sever and apply one of terminals 2 with tool 10 as already described, and sever the wire at any desired distance from the terminal with cutter 64, dropping the wire section with terminal attached into any suitable container.

While I have shown and described a specific embodiment of my invention, it will be readily apparent that many minor changes of structure and operation could be made without departing from the spirit of the invention.

What I claim as new and desire to protect by Letters Patent is:

1. In combination with a terminal for electric wires having at one end a tubular ferrule adapted to be crimped tightly about an electric wire inserted therein, and an opposite end portion, and a package for such terminals consisting of a flexible tape to which said terminals are adhered in longitudinally spaced apart relation, a tool for apply said terminals comprising:

a. first, second and third pairs of relatively pivoted jaws disposed in side-by-side relation with their operative edges extending transversely to their pivotal axes, and b. operating means operable to close said jaw pairs in the same sequence, said first jaw pair being operable to grip said tape and said opposite end portion of one of said terminals therebetween, said second jaw pair including blade means operable to sever said tape intermediate the terminal so gripped and the next successive terminal on said tape, and said third jaw pair being operable to grip and crimp the ferrule of the terminal so gripped by said first jaw pair.

2. The combination as recited in claim 1 wherein all of said jaw pairs are pivoted on a common axis, and wherein said operating means comprises a pair of handles respectively rigidly associated with the jaws of said third jaw pair, whereby manual pressure on said handles forces the jaws of said third jaw pair closed, an anvil a common to one of said handles serving as acommon lower jaw for all of said jaw pairs, the upper jaws of said first and second jaw pairs being pivotal in a closing direction relative to the upper jaw of said third jaw pair.

3. The combination as recited in claim 2 wherein is provided resilient means biasing the upper jaws of said first and second jaw pairs in a closed direction relative to the upper jaw of said third jaw pair.

4. The combination as recited in claim 3 with the addition of stop means limiting the closing movement of the upper jaws of said first and second jaw pairs relative to the upper jaw of said third jaw pairs to respectively greater and smaller degrees, whereby when said first jaw pair is open, said second jaw pair will be open to a still greater degree, and whereby as said first and second jaw pairs successively are closed, said resilient means permit to closure of said third jaw pair to be completed.

5. The combination as recited in claim 4 wherein the upper jaw of said second jaw pair constitutes a blade operable against said anvil, and wherein said resilient means biasing it in a closing direction is of sufficient strength to cause it to sever said tape against said anvil.

6. The combination as recited in claim 2 wherein said handles respectively include straight edges brought into aligned abutting contact when said third jaw pair is closed, said edges being sharpened and having aligned notches formed therein whereby to constitute a tool for stripping insulation from insulated electric wires.

7. The combination as recited in claim 6 wherein said abutting edges have coextensive portions which are sharpened but not notched, whereby to constitute a wire cutting tool.

* * * * *